United States Patent [19]

Butler, Jr.

[11] 4,097,925

[45] Jun. 27, 1978

[54] PROCESS AND APPARATUS FOR MIXING AND TRANSPORTING CEMENT

[76] Inventor: William H. Butler, Jr., 5315 Alvarado, Amarillo, Tex. 79106

[21] Appl. No.: 666,604

[22] Filed: Mar. 15, 1976

[51] Int. Cl.[2] ..... B28C 5/18; B28C 5/42; B28C 9/04

[52] U.S. Cl. ..... 366/2; 366/44; 366/59; 417/231

[58] Field of Search ..... 259/177 A, 177 R, 146, 259/173, 175, 176, 145, 1, 30; 60/403, 405; 417/234

[56] References Cited

U.S. PATENT DOCUMENTS

| | | | |
|---|---|---|---|
| 2,798,435 | 7/1957 | Armstrong | 417/231 |
| 3,731,909 | 5/1973 | Johnson | 259/177 A |
| 3,756,572 | 9/1973 | Buelow et al. | 259/177 A |
| 3,773,304 | 11/1973 | Hodgson | 259/177 A |
| 3,872,823 | 3/1975 | Durdin | 116/129 F |
| 3,928,968 | 12/1975 | Becker et al. | 60/403 |

*Primary Examiner*—Billy S. Taylor
*Attorney, Agent, or Firm*—Ely Silverman

[57] ABSTRACT

By a combination of a slump indicator calibrated for each of the several particular trucks in a system of concrete mixer transport trucks and a particularly readily locatable dynamically balanced emergency power unit, the contents of the drum or mixer of a disabled concrete mixer truck are mixed and/or tested and/or treated and/or discharged as needed.

8 Claims, 16 Drawing Figures

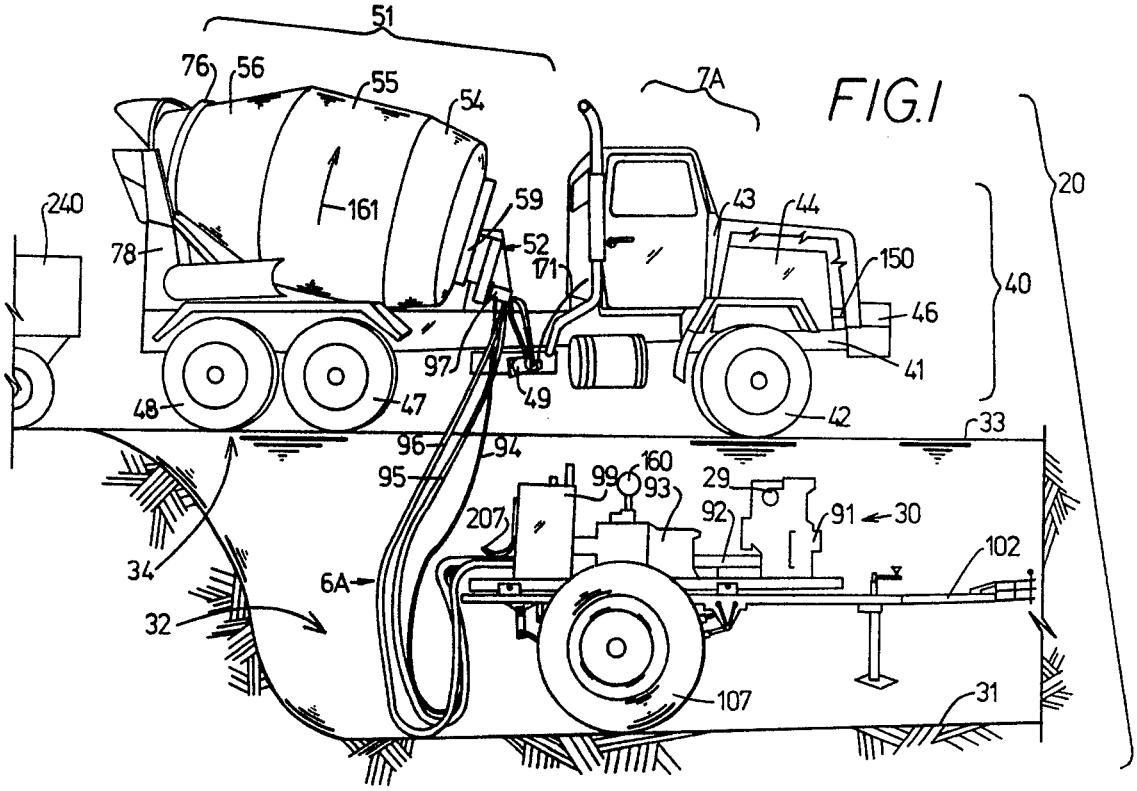
FIG.2
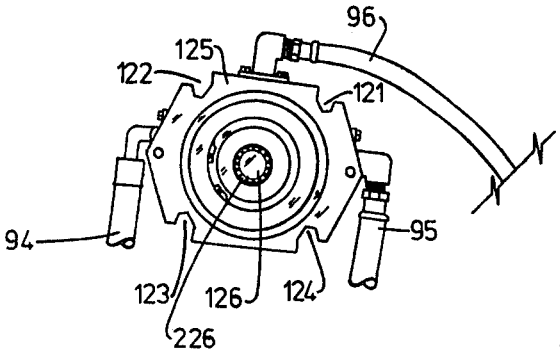
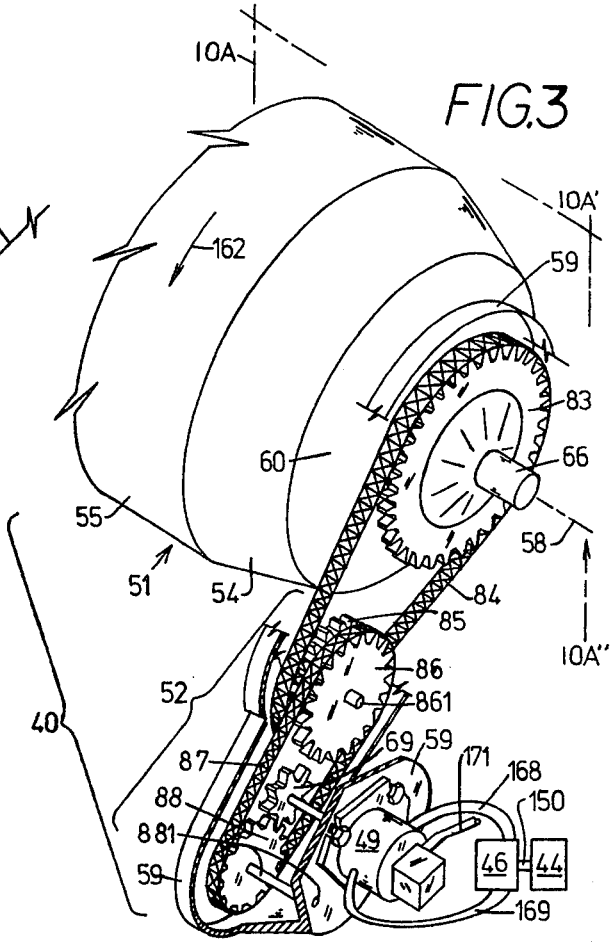

FIG.11
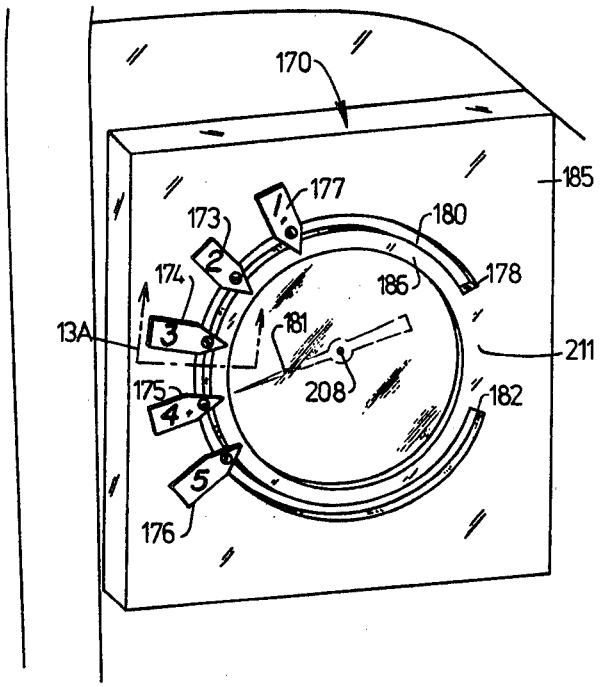
FIG.12
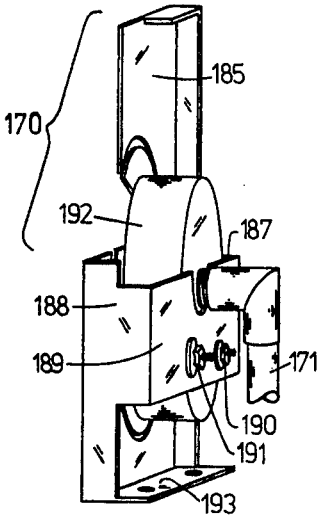
FIG.13
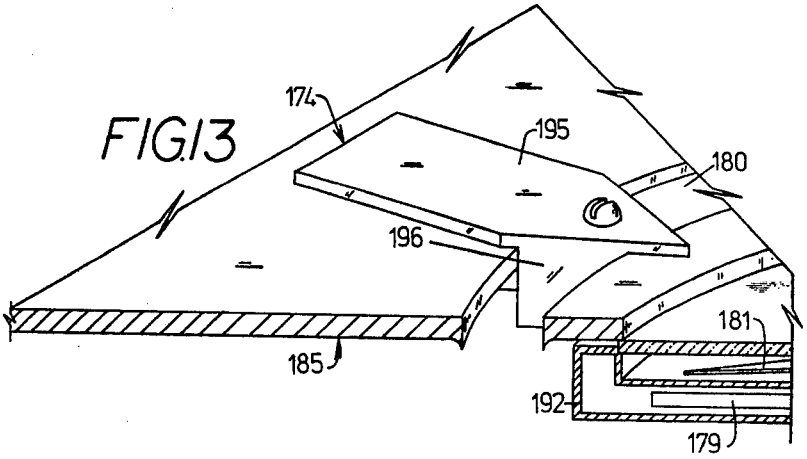
FIG.14
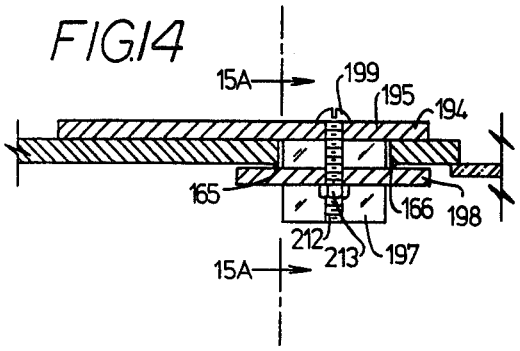
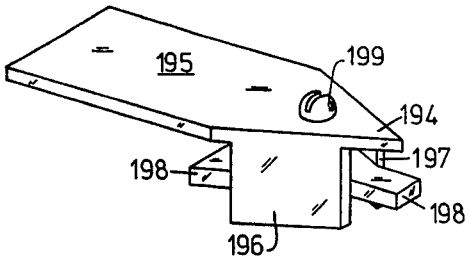
FIG.16
FIG.15
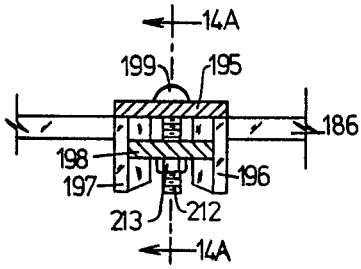

PROCESS AND APPARATUS FOR MIXING AND TRANSPORTING CEMENT

BACKGROUND OF THE INVENTION

The fields of art to which this invention pertains are concrete mixers with rotatable receptacles and hydraulic drives and dynamometers and combinations thereof.

THE PRIOR ART

The prior art of management of concrete delivery units has failed to provide rapid and economical treatment of a disabled concrete mixer truck to salvage or discharge the mixer contents thereof as well as failed to provide a rapid reliable method of appraising the most desirable disposition of the contents of a disabled concrete mixer truck or a reliable practical monitor of the mixer drum contents during transit.

SUMMARY OF THE INVENTION

A balanced mobile hydraulic emergency power unit provides power to actuate the mixer of a disabled concrete mixer truck and is adapted for location in operative connection to such a disabled concrete mixer truck in a system of like concrete mixer truck units while a slump test indicator reading sensitive to viscosity of contents of a concrete mixer truck is calibrated for each such concrete mixer truck and the emergency unit has a slump test indicator readily adjustably calibrated to match each of the trucks of the system to provide for rapid application to any of such truck units when disabled, determination of the condition of its mixer content, and treatment or discharge thereof.

BRIEF DESCRIPTION OF THE DRAWINGS

FIG. 1 is an overall side view of the assembly 20 illustrating a disabled truck 40 on a horizontally extending surface 33 and the emergency power unit 30 in operative combination with the emergency unit shown supported on a horizontally extending surface 31 at a lower vertical level than surface 33.

FIG. 2 illustrates the rear face of casing of motor 97 as seen along direction of arrow 2A of FIG. 7.

FIG. 3 is a diagrammatic representation of the power train mechanism usually connecting the gear drive motor 49 to the gear train in zone 3A of FIG. 5.

FIG. 11 is front perspective view of the slump indicator 170 shown in operative position in FIG. 8.

FIG. 12 is a rear perspective view of the slump indicator 170.

FIG. 13 is a diagrammatic perspective sectional view along zone 13A of FIG. 11 of indicator 174 and its relation to the frame therefor.

FIG. 14 is a vertical sectional view along the plane 14A—14A of FIG. 15.

FIG. 15 is a vertical sectional view along the plane 15A—15A of FIG. 14.

FIG. 16 is a perspective view of the indicator 174 and its holding bar 198.

DESCRIPTION OF THE PREFERRED EMBODIMENT

The system 20 comprises a plurality of generally alike rotary concrete mixer truck assemblies, as 40, and a mobile emergency power unit, as 30. As rotary concrete mixer truck assemblies are well known, in the herein presented embodiments the showings and descriptions are intended only to show to a person of ordinary skill in the art the mechanical features required for connection of the modifications and adaptations of the embodiments to the particularly shown conventional structures as an example of application of such teachings to various types and constructions of concrete mixers.

Figure 8:
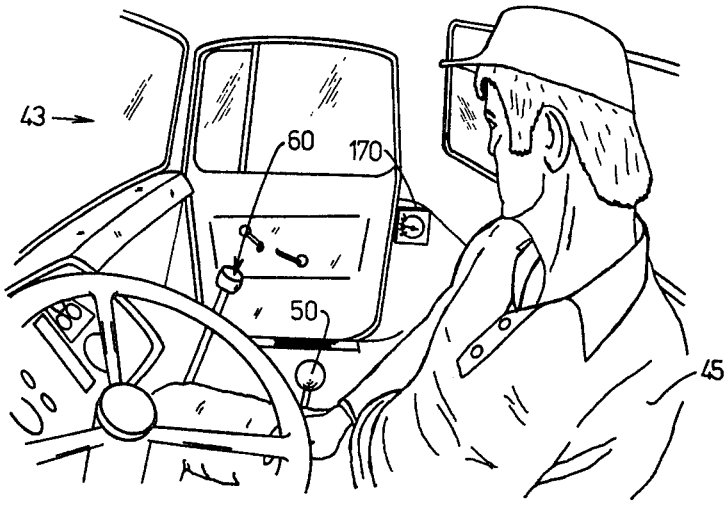
FIG. 8 is an interior view of the cab in zone 7A of FIG. 1 as seen from the left side of the cab 43 to show its interior with slump indicator 170 therein.

The transit truck assembly 40 comprises, in operative combination, a frame 41 supported on and operatively supported in conventional manner on pairs of truck wheels, (of which there are shown wheels 42, 47 and 48) a cab 43 for an operator as 45, an internal combustion engine 44 and a power take-off and hydraulic pump assembly 46. The pump 46 is operatively connected to the engine 44 and a control 50 therefor and such controls are located for control by an operator, as 45, located in the cab 43, as shown in FIG. 8. Hydraulic lines 168 and 169 connect pump 46 to engine 44.

A conventional cement mixer container 51 is rotatably supported on the truck frame 41 and driven by a power gear train 52.

The power gear train comprises a large end or driven gear 83 driven by gear chain 84 in turn driven by an intermediate reducer gear 85 fixed to and rotatable with an intermediate driven gear 86 driven by a primary drive chain 87, in turn driven by a primary drive gear 88. The entire train 52 is enclosed within and supported on a rigid casing or housing 59. In normal use a fixed displacement hydraulic motor 49 drives a pinion or output gear 69 which engages with the gear 88 to turn the container 51 through the power train 52. The gear 88 is rotatably supported on a shaft 881 firmly fixed to the housing 59. The gear 86 is rotatably supported on a rigid shaft 861 firmly attached to housing 59. Shafts 861 and 881 are parallel to each other and to axis 58 of drum 51. The gear 85 is rotatably mounted on the rigid shaft 861 and fixed to gear 86 to rotate therewith.

The drive chain 84 is looped around the relatively small diameter reducer sprocket gear 85 and the very large diameter sprocket 83 is permanently fixed to the head portion 60 of the drum 51. Gears 88 and 86 and the mounting therefor in casing 59 form a gearbox.

The drum 51 is an axially symmetrical container having a rear opening 79 and central longitudinal axis 58. Drum 51 comprises a first frusto conical section 54, a second frusto conical section 55 and a third frusto conical section 56. Each frusto conical section is a frustum of a cone. Section 54 is conical with its reduced or apical portion closer to the front of the truck than its larger portion. Section 55 is essentially cylindrical and section 56 is frustro conical with its narrower portion directed to the rear of the truck. The imperforate walls that form sections 54, 55 and 56 define a drum chamber 51 therebetween and a pair of like helical blades 61 and 71 which are firmly attached to the interior of such walls are L-shaped or T-shaped in section. Blade 61 is formed of a rigid first helical portion 62 serially connected to another helical portion 63, (shown in dashed lines in FIG. 10) which in turn is serially connected to a helical portion 64 (shown in solid lines in FIG. 10) connected to a further rearward portion corresponding to portion 73 of the blade 71. Blade 71 is composed of a first helical portion (not shown) which blade portion is the mirror image of blade portion 62, such portion is followed by the helical blade portion 72, shown in FIG. 10, and blade portion 72 is sequentially joined to a helical portion which is the mirror image of portion 64 and that portion is sequentially joined to a terminal helical portion 73. For all portions of the helical blades 61 and 71, as portion 72 of blade 71, the base or web portion as 65 of each tee or L-section is firmly attached at its outer edge to the wall of the container and extends toward the axis of the drum for from 0.4 to 0.5 of the distance from the wall to the axis. The blades are shown to scale as is the shape of the drum 51 in FIG. 10.

Figure 10:
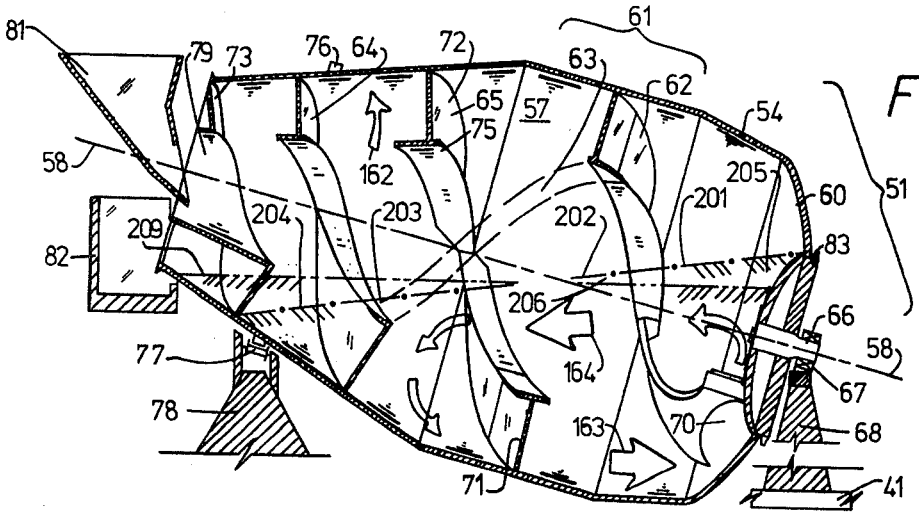
FIG. 10 is a vertical longitudinal diametral sectional view through the vertical diametral plane indicated by arrows 10A, 10A' and 10A" of FIG. 3 and passing through the central longitudinal axis of drum 41. It is drawn to scale.

The web portion, as 62, of each of the blades 61 and 71 is helical in shape as shown in FIG. 10. The interior edge of the web of each blade is firmly joined to a crossbar portion, as 75, that extends parallel to the drum axis 58 as shown to scale in FIG. 10. Near the head portion 60 a hole 70 is provided in the base or web portions of blades 61 (and 71).

The power train for driving the container, as 51 from the engine 44 is shown in the preferred embodiment with the truck engine 44 as the source of power to rotate the drum 51 and the power take-off 150 is an automotive type drive line directly bolted to the front end of the engine crank shaft. Alternatively, the power train source may be a fly wheel take-off with a hydraulic pump mounted on a cross member of frame 41 rearwards of the location of the fly wheel of engine 44 with a drive line connecting such fly wheel power take-off to a hydraulic pump: a hydraulic oil reservoir oil filter and hose assembly are then mounted on cross frame brackets behind the cab 43 and the heat exchanger is positioned in front of the truck radiator to utilize the cooling effect of the truck fan.

With either power take-off arrangement the engine provides torque to a variable displacement hydraulic pump, as 46, which sends hydraulic fluid under pressure to a fixed displacement hydraulic motor, as 49, and the fixed displacement hydraulic motor 49 provides power to the final drum drive gear train 52. In the embodiment 40 herein shown the power take-off used is the engine take-off.

Generally, the drum 51 is rotatably supported in position by a three (3) point suspension comprising a front shaft 66 and a circular rear track 76; i.e., there is a front central longitudinal shaft 66 in the front end of the middle of the head plate 60 at the front of the drum 51 which revolves in a self-aligning spherical roller bearing 67. Bearing 67 is supported by a rigid front pedestal 68 and pedestal 68 is firmly attached onto the frame 41 and a circular track 76 is welded around the outside of the rear portion 56 of the drum 51. Track 76 rides on a pair of trunnion bearings, as 77, both members of which pair of bearings are supported on a rear pedestal 78. The rear pedestal 78 is also supported on a vehicle frame. The central longitudinal axis 58 is directed upward and rearwardly at an angle of fifteen degrees (15°) to the horizontal when the wheels of the vehicle 40 are supported on a horizontal surface, as 33.

The discharge end opening 79 of the container 51 is adjacent to a charge hopper 81 for feeding or charging mix into the container 51 and a discharge collector chute 82 is located immediately below the opening 79 for receiving discharge from the drum 51; collector chute 82 is attached by a chute ring 83 to the conventional chutes, as 80.

Control of the speed of rotation of the drum 51 is accomplished by (a) throttle control of the speed of engine 44 and (b) by varying the amount of hydraulic liquid displacement of the pump 46 to increase or decrease the flow of hydraulic liquid to the hydraulic motor 49. Reversal of drum rotation direction is accomplished by reversing the direction of flow of the hydraulic pump 46 as by a control valve 60 in the cab 43 so that the motor 49 turns in the opposite direction. In the container discharge direction of flow of hydraulic fluid to motor 49 the vanes 61 and 71 move and raise portions of the concrete mix within the container 51 toward the discharge opening 79 and discharge the mix through the drum orifice 79. This drum rotation is in the clockwise direction as seen from the cab 43 and such direction of rotation is shown by the arrow 161 in FIG. 1. During mixing and transport operation the drum 61 is turned counterclockwise as seen from the cab 43; i.e., in the direction of the arrow 162 as shown in FIG. 3. In such mixing direction (shown as direction of arrow 162 in FIGS. 3, 5 and 10) the vanes 61 and 71 cause a flow of the concrete in the cycle shown by arrows 163 and 164 in FIG. 10 and cause the portions of level of concrete mix in the container 51 to reach an elevated level, as 201, at the front end of the container between the most advanced portion of the vanes, as 61 and successively lower levels 202 and 203 and 204 rearwardly, as shown in FIGS. 10 between the portions of vanes. As shown in FIG. 10 during such drum rotation there are volume portions 205 and 206 of mix 200 raised above the upper level 209 of the mix 200 when the drum 51 is static. During static condition of the drum 51 at the rear end of the container 51, the upper surface (209) or level of the semi-liquid concrete mass 200 is higher than the upper surface or level of the mass 200 at the rear end of the drum during rotation, as shown at level 204.

A pressure gauge 170 as in FIGS. 8 and 11–15 is connected as by line 171 to the high pressure hydraulic pump line 169 used to drive the motor 49 for container 51: that gauge 170 is located in the cab of the truck as shown in FIG. 8. Motor 49 is a constant displacement motor of a predetermined size and horsepower rating. The torque developed is adequate to handle the weight of concrete raised to discharge opening 79 by the vanes 61 and 71 and the resistance met by the vanes as 62 and 61 in moving and in passing through the mixture 200 and in maintaining the resultant differences in vertical level of the slurry at the head of the drum 51 (indicated by 201 in FIG. 10) and at the level of the slurry near discharge end of the drum 51 (indicated by 204 in FIG. 10) and at intermediate zones, as at level 203.

Each of several movable indicators as 173–177 are adjustably yet firmly located at a position corresponding to the position of the pressure indicating needle 181 when the slump test characteristic of the mass 200 is that desired; e.g. 1 inch, 2 inches, 3 inches, 4 inches and 5 inches as shown by indicators 177, 173, 174, 175, respectively.

By this apparatus a slump test indicator reading is readily observable by the operator, as 45, as shown in FIG. 8 so that water may be added as needed between the site of composing the concrete mix in container 51 and the site of discharge for its intended use.

Slump indicator gauge 170 comprises (a) a peripheral rigid plate 185 and (b) a central C-shaped shoulder 186 defining therebetween, as shown in FIGS. 11 and 13, (c) a C-shaped slot 180 of uniform width from one end thereof, 178, to the other end 182 for support and location therein of one or more like indicators as 173–177, and (d) a conventional bourdon hydraulic sensor 179 with a pointer 181 operatively connected thereto in conventional manner.

The plate 185 is supported by rigid arms 188 and 187 on a rigid rear plate 189 that is firmly attached, as by bolts 190 and 191, to the casing 192 of the gauge 170; a rigid mounting bracket 193 serves to support the gauge in the cab 43. Plate 185 joins the ring-shaped shoulder element 186 by a rigid connector or support plate 211.

Each of the indicators 173–177 is alike in structure so the description of one of them (174) applies to the others (173, 175, 176, 177). Each indicator, as 174, is formed of a rigid elongated needle-shaped flat plate 195, with arms 196 and 196 firmly attached thereto and extending at right angles therefrom as shown in FIGS. 14, 15 and 16 and are rectangular in shape or outline. Each of these arms has a loose sliding fit in the slot 180. Such fit maintains the orientation of each point, as 194 of each plate as 195 during motion of such indicator plate, as 195 toward one end, as 178, or the other, as 182, of slot 180.

The position of the plate 174 and the pointed end portion thereof 194 are determined relative to the ends 178 and 182 of slot 180 by location of the vertical edges of arms 196 and 197 in one position or another along the length of the slot 180 prior to fastening the plate in position as shown in FIGS. 14, 15 and 11.

The plate 185 is punched to form the slot 180 and deformable feathered edges 165 and 166 are thereby formed: such edges are used to assist in firmly holding all of the indicator plates, as 174 in position indicative of the slump test reading. A rigid locking bar 198 extends parallel to the plate 195 and is located betweem arms 196 and 197 and is firmly yet adjustably held by a screw 199 and nut 213 against the plate 185 via the feathered edges thereof as shown in FIG. 14.

As shown in FIGS. 14 and 15 the screw 199 has a threaded shank 212 that extends substantially below the plate 198 in the firmly attached position of indicator 174 and plate 185 (as shown in FIGS. 14 and 15). The shank of the screw 199 passes through a hole in plate 198 and is firmly held in a nut 213 firmly fixed to the plate 198. The plate 198 so sufficiently loosely fits between arms 196 and 197 (as shown in FIGS. 14–16) that it may move up and downward (as shown in FIGS. 14–16) therebetween on rotation of the threaded shank of the screw 199 in the threaded portion of the nut 213 prior to tightening against plate 185. The indicator 174 is located in slot 180 at any desired position by turning and partially loosening the screw 199 so that the attachment of plate 198 to the bottom of plate 185 and 186 is loosened. The rigid plates 196 and 197 maintain the orientation of the plate 195 relative to the central pivotal support 208 of pointer 181 while the plate 194 is moved in the slot 180. The indicator 174 is set by turning the screw 199 and thereby drawing plates 195 and 196 against plates 185 and 186 by tightening the plate 198 against the bottom of plates 185 and 186. The ready deformation of the feathered edges 165 and 166 assists in such firm location of plate 174.

The setting of each of indicators 173–177 is effected in the same manner above described for indicator 174.

By operation of slump indicator gauge 170 in truck 40 the operator 45 is readily and possibly continuously apprised while traveling in truck 40 with a load 200 of the condition of the contents 200 of the drum 51 through (a) a set range of rotative speeds (as expressed in r.p.m.) of the drum 51 including especially the range of r.p.m. usually used (2 to 4 r.p.m.) during transport of the loaded mixer as 40 and through (b) a large range of proportions of relative fullness or relative emptiness of the drum relative to its volumetric capacity. Thus, slump indicator gauge 170 provides that corrective steps, such as addition of water or cement to drum 51 can be taken when drying of the mix 200 has occurred during long periods of travel or during high ambient temperatures as well as to correct for initially incorrect formulations. The 2–3 r.p.m. test speed used herein corresponds to the speed of drum 51 at the idle speed of the motor 44 of truck 40 with maximum stroke of the pump 46, so that a constant test speed is used.

The basis for slump measurement in the apparatus 40 is the hydraulic motor fluid pressure because the resistance to turning of a given drum, as 51, for a given truck, as 40, at a given speed of rotation of the drum 51 (as expressed in r.p.m.) through a set range of speed of the drum 51 is a reliable measure of the viscosity of the mixture in the drum 51 through a wide variety of range of completeness of filling of the drum so long as the blades, as 61 and 71, are covered by the load of semi-fluid concrete, as 200, within the drum 51. While a measure of the volume of fluid displaced per unit time of hydraulic fluid through motor 49 provides a measure of the speed of rotation of drum 51, that measure is not an accurate indicator of the viscosity condition of the mixture in container 51. To calibrate the gauge 170, a full load e.g. 8 cubic yards of dry concentrate is added to the drum 51 through its rear opening 79 and sufficient water is added to provide a viscosity that corresponds to a slump reading lower than the driest slump reading desired to read on the gauge 170; a 1 inch reading is used as the driest slump point reading as explanation herein. Eight cubic yards is a full load for drum 51 used as the exemplary embodiment herein. While loading, the controls for the drum are set so that drum 51 is turned in the direction (162) for mixing of the contents thereof (rather than discharge) and, while the drum is turned at about 9 r.p.m. for a period of time during which the drum turns for 70 turns, water is added to the drum. A slump sample is then drawn from the interior of the drum and such sample is measured by standard procedures, such as a standard cone (of 12 inch axial length of such cone, 8 inch circular bottom diameter and 4 inch top diameter). If needed, further additions of water are made during further periods of time for which the drum is similarly rotated at the similar speed of about 9 r.p.m. (in range of 8 to 10 r.p.m.) for 70 turns to effect good mixing of the mix 200; after each such periods of time and mixing, samples of the resulting mixture 200 in the drum 51 are drawn until a slump test reading of 1 inch is obtained. While in its mixing mode (rotating in direction 162) the drum 51 is then turned at speed of 2 to 3 r.p.m. and, during such turning the indicator 177 (the 1 inch slump indicator) is set at the reading of the pointer 181. The gauge 170 is thereby calibrated for 1 inch slump concrete.

While the controls for the drum are set so that drum 51 is turned in the direction (162) for mixing of the contents thereof (rather than discharge) and, while the drum is turned at about 9 r.p.m. for another period of time during which the drum turns for 70 turns, additional water is added to the drum. A slump sample is then drawn from the interior of the drum and such sample is measured by standard procedures, such as a standard cone (of 12 inch axial length of such cone, 8 inch circular bottom diameter and 4 inch top diameter). If needed, further additions of water are made during further periods of time while drum 51 is similarly rotated at the similar speed of about 9 r.p.m. (in range of 8 to 10 r.p.m.) for 70 turns to effect good mixing of the mix 200; after each of such periods of time and mixing, samples of the resulting mixture 200 in the drum 51 are drawn until a slump test reading of 2 inches is obtained. While in its mixing mode (rotating in direction 162) the drum 51 is then turned at speed of 2 to 3 r.p.m. and, during such turning the indicator 172 (the 2 inch slump indicator) is set at the reading of the pointer 181. Slump indicator gauge 170 is thereby calibrated for 2 inches slump concrete.

More water is then added over other subsequent periods for 70 turns of the drum 51 at a speed of 9 r.p.m. while the drum 51 turns in the mix mode and further samples are drawn and each of such samples is tested for slump readings: additional water is added to drum 51 as needed until the slump reading of the samples is 3 inches. The drum 51 is then continued to be rotated at 2 to 3 r.p.m. and the indicator 174 is then set at the reading of pointer 181. Indicator gauge 170 is thereby calibrated for the reading of a 3 inch slump. Similarly, water is added and samples are drawn and those samples are tested until, similarly, a 4 inch reading is obtained by slump test, and indicator 175 is set opposite the pointer as 181. Gauge 170 is thereby calibrated for the reading of a 4 inch slump. Similarly, water is added and samples are drawn and those samples are tested until similarly a 5 inch reading is obtained by slump test. Indicator 176 is set opposite the pointer 181 and the slump indicator gauge 170 is thereby calibrated for the reading of a 5 inch slump. The gauge 170 is thus calibrated for drum 51 through the full range of slumps of 1 inch through 5 inches.

The mobile emergency power unit 30 comprises an internal combustion engine 91, a transmission 92, a variable displacement hydraulic swash plate pump 93, a set of flexible conduits 94, 95 and 96 and a fixed displacement hydraulic motor 97. The assembly 90 is provided with a fairly rigid dimensionally stable frame 101 comprising rigid longitudinal members as 102 and rigid transverse members, as 106 firmly joined together.

A left wheel 107 and a right wheel 108 are attached by springs 104 and 105, respectively to the frame 101.

The engine 91 is a standard 9 horsepower adjustable speed gasoline internal combustion engine.

The transmission 92 has U-joints 136 and 139 to correct for minor misalignment of axle 115 of the pump 93 and the drive shaft 89 of engine 91.

The hydraulic pump 93 is a reversible and variable displacement pump and is controlled by the displacement control valve assembly 98 (shown diagrammatically in FIG. 7) which displacement control valve is operatively connected to and controlled by a displacement control handle 109.

Generally, the reversible and variable displacement swash plate pump 93 comprises, in operative combination, a rigid casing 110 and therein a rotatable drive shaft 115 and a movable swash plate 114, and is connected to pressure indicator gauge 160.

The swash plate 114 is a rigid circular plate concentric with shaft 115 and is in part pivotally supported on trunnions, as 134, each trunnion attached to the casing 110, and is in part pivotally supported and positioned by pistons, as 142 and 143 in servo cylinders 112 and 113. The position of the swash plate 114 is controlled by cylinders 113 and 112 wherein compressed return springs, as 143 and 142, respectively are also located. A rotatable piston cylinder block 119 holds a plurality, usually 7 or 9, drive pistons as 144 and 145.

The swash plate support trunnions, as 134, are on an axis which extends on a line at right angles to the axes of the servo pistons and of axle 115. The lengths of each of the drive pistons 144 and 145 as well as the pistons in the servo cylinders 112 and 113 extend parallel to the axle or shaft 115. Shaft 115 is driven to rotate about its axis by the motor 91 and transmission 92.

Figure 7:
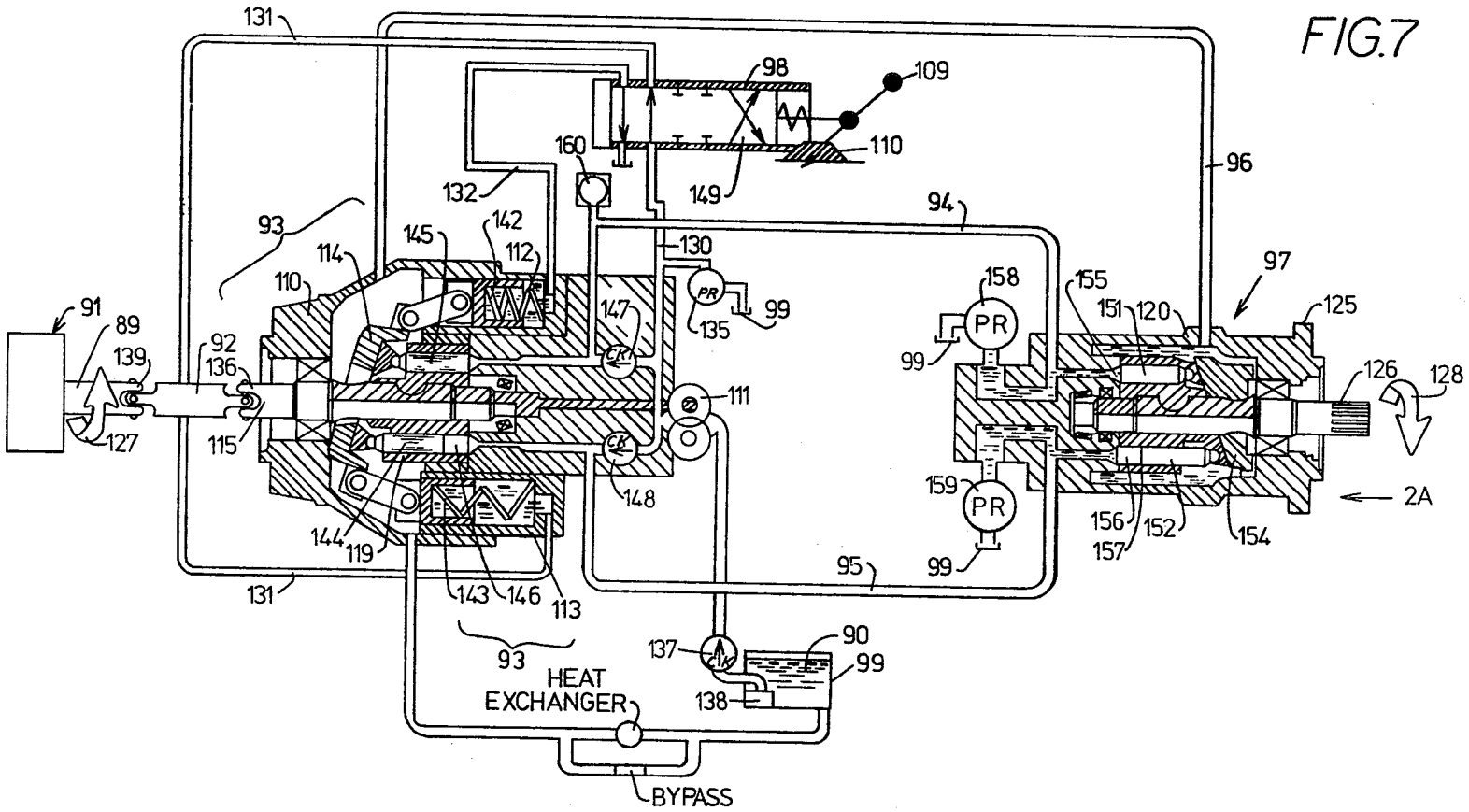
FIG. 7 is a diagrammatic showing of the pump and motor portions of the emergency unit 30 and connections therebetween.

The rotary motion of the swash plate, when tilted (as shown in FIG. 7) so that its central longitudinal axis is directed at an angle to the axis of the shaft 115 causes the drive pistons as 144 and 145 to move lengthwise in the block therefor and drives hydraulic liquid through lines 94 and 95 to motor 97. A return drain line 96 returns the cooling portion of the hydraulic liquid to the pump and reservoir 99. The amount of the displacement of each of the pistons, as 144 and 145, in the cylinders therefor, as 146 for piston 144, is determined by the angle to the axis of the shaft 115 at which the swash plate is fixed by the location of the pistons in their cylinders. A charge pump 111 is fixed to casing 110 and is also driven by the shaft 115: pump 111 drives hydraulic liquid through check valves 147 and 148 and the swash plate pump pistons, as 144 and 145, drive such fluid into the lines 94 and 95 toward the motor 97.

The control arm 109 is operatively connected to spindle 149 of valve 98 and locates the three-wave valve spool or spindle 149 of valve 98 to send high pressure fluid from the charge pump 111 (via line as 130) to either of line 131 or 132 and through lines 131 and 132 to the cylinders 112 and 113 and thereby (in co-operation with springs 142 and 143 in cylinders 112 and 113) control the position of the swash plate and the volume of liquid displacement of liquid passed to the pump 93 at a given speed of the output shaft 89 of the motor 91. Generally similar variable displacement swash plate pumps are shown in Bulletin 9565, Revision E, January 1975, entitled "Heavy Duty Transmissions," Engineering Application Manual at pages 4 and 5 with schematic drawings at pages 22, 23 and 24 of Sundstrand Corp., Ames, Iowa.

The positive displacement motor 97 comprises a rigid casing 120 and an outer flange 125. The flange is provided with notches 121, 122, 123 and 124 for holding that flange, and the casing 120 which is firmly attached thereto, to housing 59 of power train 52 of truck 40 to provide a co-operative relationship between the variable displacement pump 93, hydraulic motor 97, motor 91 and the contents of container 51.

The constant displacement motor 97 comprises a plurality, usually 7 to 9 of like pistons, as 151 and 152, each in a respective cylinder therefor, as 155 and 156 in a rotatable cylinder block 157. The block is fixed to an output shaft 126 and is co-axial with that output shaft 126: the cylinder block and shaft are rotatably yet firmly attached to the motor casing 120. The pistons contact the fixed swash plate 154 and are moved along their length by the hydraulic fluid passed thereto by lines 94 and 95 under pressure.

Figure 6:
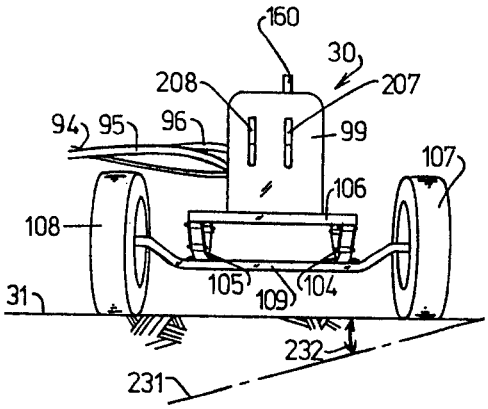
FIG. 6 is a front view along the direction of the arrow 6A of FIG. 1 showing the emergency power unit 30 in an operative position thereof.
Figure 9:
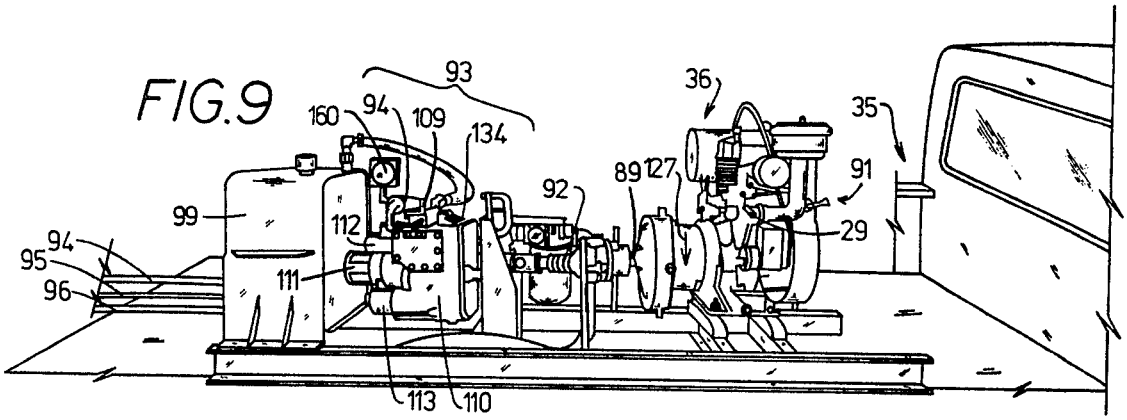
FIG. 9 is an enlarged side view of another embodiment of emergency power unit 36 as seen from the left side thereof on the bed 220 of the bed truck 35.

The motor 97 is a fixed displacement motor as is described in Heavy Duty Transmissions, Engineering Application Manual, Sundstrand Hydro-Transmission, Ames, Iowa, Bulletin 9565, Revision E, January 1975, pages 14, 19, 20 and 50, Series 22, with 4.26 cubic inches of displacement per revolution, and maximum shaft speed of 3,200 r.p.m. with a corner horsepower (CHP) 173. Corner Horsepower is a numerical value describing the capability range of a transmission, the range being the maximum torque and the maximum speed available, not necessarily simultaneously, and is greater than the transmitted horsepower (about 9 HP in this case). The overall length of motor 97 is 16 inches. The overall diameter of plate 125 is 8½) inches. Shaft 126 has a major/minor diameter of 1.2293/1.2223 inches and teeth have pitch diameter of 1.667 inches, with total of 14 teeth with 30° pressure angle; 12/24 pitch, Class 1, 1963, S.A.E. Handbook. Other data are available in Sundstrand Bulletin 9565, Rev. E. (cited at page 18, lines 4–7 above) at pages 19 and 20. A gauge 160 identical in structure to gauge 170 is attached to the high pressure line 96 as shown in FIGS. 6, 7 and 9 via a manifold connected also to the high pressure relief valve 158 of motor 97. It (gauge 160) is readily adjusted to match the calibration of the gauge 170 on the disabled truck, as 40, and thereby provides measure of the condition of the mix as 200 in a disabled truck as 40, as shown in FIGS. 1 and 10.

The hoses 94, 95 and 96 are each conventional high pressure (5,000 p.s.i.) flexible hose 20 feet in length and 2 inch outside diameter.

In operation of a unit such as the transit truck assembly 40 there are frequently engine break-downs that prevent such truck assembly from continued transportation operation and also, as a result of such break-down, the continued mixing operation of the mixer container 51 is prevented. Such circumstances of breakdown are as usual as any other truck or automotive engine breakdown; however in the situation of a transit mixer the physical characteristics of the mixture (200) in the drum 51 change.

When such engine break-down occurs due to mechanical or electrical failures in the engine, as 44, the concrete of mixture 200 may set and this not only causes an economic loss of such contents but also may damage the container because if concrete in drum 51 sets in it, removal of such concrete set within the drum 51 is a time consuming and expensive operation. Also the truck 40 with a load of cement therein is not amenable to being tilted as such affects the load carrying capacity of the container 51 as well as the center of gravity of the truck 40 when fully loaded (with total weight of 54–58,000 lbs.).

Figure 5:
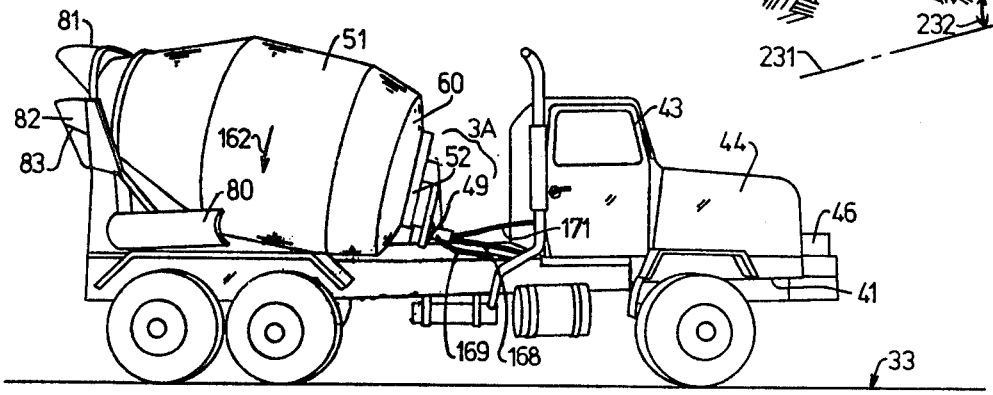
FIG. 5 is a side view of the truck 40 in its operative condition during mixing and transport of the contents of the mixer container 51.

The truck 40 and similar cement mixer trucks with a high center of gravity and an elevated and axially symmetrical drum as 51 with its central longitudinal axis (about which axis such drum is symmetrical) tilted at an angle to the vertical as shown in FIGS. 1, 5 and 10 are in a teeter position when positioned with more than 30° side to side tilt relative to the horizontal. By the term "side to side tilt" is meant a position of a truck as 40 where the wheels 42 and 47 and 48 on the right side of truck 40 would be lower (or higher) than the corresponding wheels on the other side of truck 40). The contents of the drum 51 also require a relatively horizontal wheel support surface as 33 or one directed downwards and forwards (down and to right as shown in FIGS. 1 and 5) i.e., a downhill grade—to avoid spillage of the contents of drum 51 after it is filled on a horizontal grade: however, discharge of the contents of a container as 51 is more difficult from a container, as 51, on a truck on downhill grade. Accordingly, it is desirable that a disabled concrete mixer truck, as 40, be located on level ground. However, truck assemblies, as 40, when disabled are usually disabled in locations such as construction sites where access to such vehicle is inconvenient, such as on surfaces that are not paved roads, usually rough surfaced as well as soft and narrow.

Figure 4:
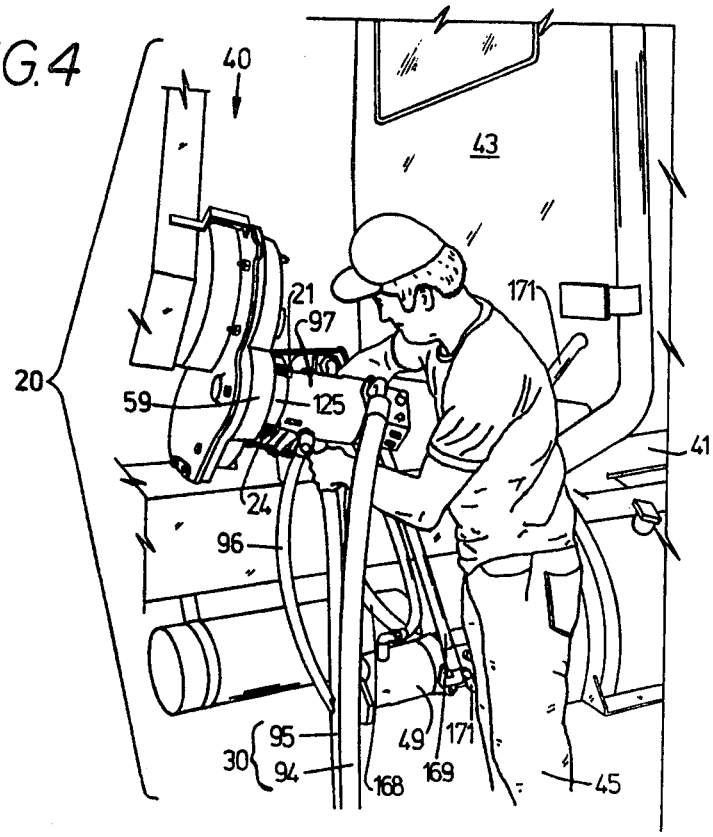
FIG. 4 is a perspective pictorial view of an operator 45 placing the emergency unit motor 97 in place on the casing 59 of the gear train 52 of a disabled truck 40.

In operation of the apparatus 30 the motor 49 is removed from housing 59 and motor 97 is removed from its J-shaped support brackets 207 and 208 on reservoir tank 99 of the unit 30 and, as shown in FIG. 4 located on the housing 59 that encloses the gear train 52 and, then, bolts 21 and 24 are placed in slots 121 and 124, respectively, of plate 125 and like bolts in slots 122 and 123 and tightened to firmly join the casing 120 of motor 97 to the casing 59 of the gear train 52, as shown in FIG. 4, and so operatively connect the teeth 226 of output shaft 126 of motor 97 to the teeth of gear 88 of train 52. Such disconnection of motor 49 and connection of motor 97 is completed in 2 minutes. The motors 97 and 49 are chosen to be substantially the same in function, internal mechanical elements, size and shape. The indicators on gauge 160 are set to match the position of indicators 173–177 on gauge 170. The internal combustion engine 91 is then started and operated and drives its output shaft 89 clockwise as seen from left side of FIG. 1 and shown by arrow 127 in FIGS. 7 and 9: the reaction of such motion on the casing of the engine 91 causes the opposite reaction on the frame of the engine 91 and on the frame 101 of the assembly 30. The torque of output shaft 89 is applied to axle 115 of pump 93 and through cylinder block 119 via plate 114 to the casing 110 of pump 93 and therethrough to the frame 101. Accordingly, the torques applied to the frame 101 by engine 91 and pump 93 are balanced. The liquid moved axially by the pistons as 144 and 145 moves symmetrically parallel to the axis of shaft 115 and to high pressure line 94 and low pressure line 95 without development of torque reaction against frame 101 while driving the drum 51 in one direction, as 162, to mix its contents or while driving the drum 51 in the other direction (161) to empty its contents. Such emptying may be done into another wheeled container, such as 240.

In apparatus 30 the net torque on its support wheels is balanced. Therefore, apparatus 30 may be located on non-level surfaces, for instance, as shown in FIG. 1, in a ditch as 32 adjacent to a narrow road, as 34 and there provide for its rapid connection to truck 40 and applying the torque needed for efficiently rotating the drum 51 and its contents (about 25,000 lbs. for mix 200 in the 8 cubic yard container 51) so that, as one alternative, the contents of the container 51 of the disabled truck 40 may be rapidly and continuously mixed and so avoid settling of the larger particles such as the gravel within the concrete and water mix 200; or, as another alternative, so that the drum 51 be driven in a direction to empty the contents thereof while such contents are sufficiently fluid to be readily discharged by the usual discharge operation of drum 51.

The surface 31 of the ditch 32 is shown for illustrative purposes as level in FIGS. 1 and 6 but apparatus 30 could operate on a surface tilted at a substantial angle, as 232 (as 40°) to horizontal (shown as 231 in FIG. 6) without affecting the operation of the unit 30 while maintaining (when connected to truck 40 as above described and shown in FIG. 1) the mixing action (by rotation of drum 51 in direction 162) on contents of drum 51 or effecting discharge (by rotation of drum 51 in direction 161) of contents of drum 51 because of the balancing of torque in the apparatus 30.

The ready matching of the gauge 170 in a truck as 40 to the gauge 160 on the unit 30 as well as the substantial extensibility of the hoses 94, 95 and 96 from the frame 101 of unit 30 provides a synergistic combination of emergency unit 30 and the disabled truck 40.

Unit 30 has a substantially shorter length and lesser width and weight than the truck 40 (unit 30 has a total weight of 500 pounds, a total length of 8 feet as shown in FIG. 1 and a total width (FIG. 6) of 4 feet) and therefore may be located on a surface 31 which is not level and may therefore be readily located adjacent to a disabled truck, as 40, as in ditches and on road shoulders. The unit 30 provides that, by operation of the engine 91 and control of its throttle 29 and the control valve 109, the speed and direction of the shaft 126 of motor 97 and the power thereto may be controlled as desired by the operator to provide a desired speed of the drum 51 during an emergency or disabled condition of truck 40 and also to quickly obtain at the gauge 160 a measure of the viscosity of the contents of the container 51. Gauge 160 is the same in structure and calibration as gauge 170. Adjustable gauge as 160 has the same structure as in FIGS. 11–16 whereby the gauge 160 may be rapidly set (as above described for setting of gauge 170) to the same slump calibration as in the truck 40 or any of several trucks as 40 in the system including truck 40.

The combination of gauge 160 and assembly 30 with a disabled truck as 40 with a load of concrete therein thereby provides a rapid determination of the condition of the mix, as 200 in a disabled truck as 40 and thereby permits a reasonable rapid decision as to whether or not to attempt to keep the mix 200 in condition for emptying until repair of such truck is completed. Thereby such use of unit 30 may avoid (if emptying is shown not necessitated) necessity of immediate emptying of the contents of drum 51 and thereby salvage a load of concrete otherwise wasted: while, if emptying is thereby (by unit 30) rapidly determined as necessary, arrangements may be rapidly made to empty the drum 51 and so avoid damage to such drum as would result from setting of concrete therein and also to rapidly arrange (as by telephone call to dispatch site of such trucks) to dispatch another load of such concrete mix to the site of intended use of the load in the disabled truck and so avoid delay and expense to the operations awaiting delivery of such load.

If emptying is determined as not necessary unit 30 provides for rapidly determining (and controlling) the viscosity of contents of the mix (in response to the measurement of slump recorded on the gauge 160) so that the viscosity of the mix 200 in container 51 may be kept controlled.

If emptying is determined as necessary by unit 30, as where slump rate is too high and large concrete lumps have been formed in drum 51, the contents 200 may be emptied into another truck, as 240 and so avoid damage to the local area in which the disabling of such truck occurred as well as avoiding damage to the container 51 from damage resulting otherwise from such breakdown.

The emergency power unit 36 is generally identical to the unit 30 except that a bed or pickup truck 35 is used to support that unit. The emergency power unit 36 comprises a pump the same as 93, an engine the same as 91 and a motor the same as 97 as in unit 30 and conduits as 94, 95 and 96. The pump and engine are similarly operatively connected and similarly supported on and firmly attached to longitudinal and transverse members of the frame 101, and the motor 97 is removably supported on J-shaped support members 207 and 208 which are in turn firmly attached to and supported on the vertical outside wall of the rigid reservoir 99, which reservoir is a chamber which is firmly attached to the frame 101, all as in assembly 30. The pump 93 is a series 22 model, 4.26 cubic inch/Rev. (18°) described at pages 14, 15 and 16 of Sundstrand Bulletin E (herein above described at page 18, lines 4–7).

The hydraulic motor 49 used in truck 40 is identical to the motor pump 97 above described.

The controls 50 for the pump 46 are located near the gear shift control 60 in the cab 43 of truck 40 as shown in FIG. 8.

Truck 40 is a Challenge Hydro-Stat Mixer made by Challenge-Cook Bros., 15421 Gale Avenue, Industry, Calif., 91745, with an 8 cubic yard drum.

The lack of stability of such trucks is demonstrated by that drum speeds of 10 r.p.m. are taught by its manufacturer as not to be exceeded thereby during transit and, as the truck mixer drum 51 has a clockwise rotation (viewed from the rear) care is conventionally taught as necessary on making right hand turns.

Details of such truck construction are conventional and are known to those skilled in the art and set out in C.C.B. Challenge Truck Mixer, Hydro-Stat Hydraulic Drive Models 2 and 8, Operation and Service Manual, Form No. OSM-61-473 made by Challenge-Cook Bros.

Details of the gauge 170 (and 160) are set out in Table I.

TABLE I

SLUMP INDICATOR GAUGE 170 DATA

| | | | In. | Cm. |
|---|---|---|---|---|
| Plate | Length | (left to right in FIG. 14) | 7/8 | (2.2) |
| 195 | Width | (left to right in FIG. 15) | 1/4 | (0.6) |
| | Thickness | (top to bottom in FIG. 14) | 1/32 | (0.08) |
| Arm | Length | (left to right in FIG. 16) | 3/16 | (0.4) |
| 196 | Height | (top to bottom in FIG. 16) | 3/16 | (0.4) |
| Plate | Width | (left to right in FIG. 11) | 5 3/4 | (14.6) |
| 185 | Height | (top to bottom in FIG. 11) | 5 1/4 | (13.3) |
| Slot | Max. | (top to bottom in FIG. 11) | 4 1/4 | (10.7) |
| 180 | Diameter | | | |
| | Width | (left to right In FIG. 14) | 1/4 | (0.6) |

The conduits 94, 95 and 96 extend for up to 20 feet from the left end of the pump 93 as shown in FIG. 9 (for conduit 94) around the distant (right hand as shown in FIGS. 1 and 9) end of motor 91 back to the carrying location of motor 97 on supports 207 and 208 on the left end (as shown in FIGS. 1 and 9) of the reservoir 99 which reservoir is supported on frame 101, when motor 97 is in its transport position.

The pressure in lines 94–96 is in the range of 0–5,000 p.s.i. and the range of sensor 179 is 0–5,000 p.s.i.

I claim:

1. A system comprising a plurality of like rotary concrete mixer and transport trucks and a mobile emergency power unit; said rotary concrete and transport mixer trucks each comprising, in operative combination, a truck frame, an engine, a hydraulic pump and a hydraulic motor, a gear train and a concrete mixer container, said engine operatively connected to and driving said pump, said pump in operative connection to and driving said motor, said motor operatively connected to and driving said gear train through a connection therebetween, said gear train operatively connected to and driving said concrete mixer container, said connection between said motor and said gear train being detachable, said truck frame having a longitudinally extending axis parallel to its length, said concrete mixer container located above said truck frame and being axially symmetrical and rotatable about a central longitudinal axis directed upward and rearwards, means in said concrete mixer container to move a fluid concrete mass longitudinally of said container, each said concrete mixer and transport truck being unstable beyond a prdetermined degree of tilt relative to the horizontal about the longitudinal axis of said truck frame, said mobile emergency power unit consisting essentially of a mobile unit frame, a mobile unit engine, a mobile unit hydraulic pump, a plurality of flexible conduits and a mobile unit motor, said mobile unit engine operatively connected to said mobile unit pump and said mobile unit pump permanently connected through said flexible conduits to said mobile unit motor, said mobile unit motor comprising a mechanical output means connectable to said gear train and support means adapted to hold said mechanical output means in operative connection to said gear train, said mobile unit engine and said mobile unit pump fixedly attached to a mobile unit frame, mobile unit motor support means firmly attached to said mobile unit frame, said mobile unit motor is releasably supported on said mobile unit motor support means during transport of said motor on said mobile unit frame, said flexible conduits then extending between said mobile unit pump and said mobile unit motor from a point on said mobile unit pump furthest from said mobile unit engine to a point on said mobile unit engine furthest from said mobile unit pump and being extensible from said mobile unit, said mobile unit frame having a longituidinal axis extending parallel to its length, said mobile unit engine having a mobile unit engine frame and mobile unit engine output means and adapted to apply torque to said mobile unit frame in one direction and said mobile unit pump having a mobile unit pump frame and means adapted to apply an equal torque to said mobile unit frame in a direction opposite to said one direction, and wherein said mobile emergency power unit is stable at a greater degree of tilt relative to the horizontal about the longitudinal axis of said mobile unit frame than the predetermined degree of tilt relative to the horizontal axis of said truck frame beyond which said concrete mixer and transport truck is unstable.

2. A system as in claim 1 wherein said motor of said mobile unit is connected to said gear train of said concrete mixer and transport truck and said motor is then at a greater distance from said mobile unit pump than the distance between said mobile unit motor and said mobile unit pump during transport of said motor on said motor support means of said mobile unit frame.

3. System as in claim 2 wherein said concrete mixer and transport truck comprises a slump indicator gauge, said slump indicator gauge comprising a hydraulic sensor and a gauge pointer operatively connected thereto, and a gauge frame, an output line between said hydraulic pump and said hydraulic motor of said concrete mixer truck and an operator's cab;

said gauge frame affixed to said cab, said cab affixed to said truck frame, said hydraulic sensor and pointer supported in said gauge frame, said hydraulic sensor operatively connected to the output line of said hydraulic pump on said concrete mixer truck, and a plurality of indicator means movable located on said gauge frame relative to said pointer and fixed in locations quantitatively indicative of slump characteristics of a load of concrete in said concrete mixer container; and said mobile emergency power unit comprises a second adjustable slump indicator gauge comprising a second hydraulic sensor, a second pointer and a second gauge frame; an output line between said mobile unit pump and said mobile unit motor, said second hydraulic sensor and a second pointer operatively connected and supported on said second gauge frame, said second hydraulic sensor operatively connected to the output line of said mobile unit hydraulic pump and indicator means on said second gauge frame movably located on said second gauge frame relative to said second pointer and fixable in locations relative to the second pointer and matching the positions of said indicator on said slump indicator gauge affixed to said operator's cab on said truck and similarly quantitatively indicative of the slump characteristics of a load of concrete in said concrete mixer container.

4. A mobile emergency power unit comprising a mobile unit frame, an engine, a hydraulic pump, a plurality of flexible conduits and a motor, said engine operatively connected to said pump and said pump operatively connected through said flexible conduits to said motor, said motor comprising a mechanical output means, and means for selectively connecting said mechanical output means to a gear train, support means adapted to hold said means for selectively connecting said mechanical output means to said gear train and for holding said mechanical output means in fixed spatial relation to said gear train, said engine and said pump fixedly attached to a mobile unit frame, said motor releasably supported on said motor support means, said flexible conduits extending between said pump and said motor and being flexibly extensible from said frame; said mobile unit frame having a longitudinal axis extending parallel to the length of said frame, said engine having an engine frame and an engine output means adapted to apply torque to said mobile unit frame in one direction, said pump having a pump frame and a means adapted to apply an equal torque to said mobile unit frame in a direction opposite to said one direction, and wherein said mobile emergency power unit is stable at a degree of tilt in excess of 30° relative to the horizontal about the longitudinal axis of said mobile unit frame.

5. Apparatus as in claim 4 wherein said mobile emergency power unit comprises an adjustable slump indicator gauge, said gauge comprising a hydraulic sensor, a pointer and a gauge frame, and an output line of said hydraulic pump, said line extending between pump and said motor; said hydraulic sensor and said pointer operatively connected together and supported on said gauge frame, said hydraulic sensor operatively connected to said output line of said hydraulic pump, and indicator means movably located on said gauge frame relative to said pointer and fixable in locations on said gauge frame, whereby to indicate slump characteristics of a load of concrete in a cement mixer container.

6. In the process of transporting a load of unset concrete mix in a rotatable concrete mixer container on a concrete mixer and transport truck the improvement which comprises the process of protecting said concrete mixer and transport truck against damage due to failure of power transmission to said rotatable concrete mixer container by the steps of:

(a) developing hydraulic pressure on a first hydraulic fluid and applying said thereby pressurized first hydraulic fluid to a first hydraulic motor and, thereby, developing a torque output from said motor and applying said motor's torque output to said concrete mixer container and thereby rotating said rotatable concrete mixer container and, also, a load of concrete mix in said container and mixing said load of concrete mix at a first speed of rotation of said container while said truck is stationary at a first location and then (b) rotating and mixing said load and transporting said load of said concrete mix in said concrete mixer container on said truck to a second location distant from said first location and, on cessation of said torque output from said motor to said load of concrete at a location distant from said first location, (c) transporting an engine and a pump and another hydraulic motor to said second location on a movable frame therefor, (d) disconnecting said first motor from said concrete mixer container and connecting said another hydraulic motor at said second location to said concrete mixer container and (e) driving said pump by said engine, pressurizing a second hydraulic fluid and passing said pressurized second hydraulic fluid from said pump to said another hydraulic motor and rotating said concrete mixer container by said another hydraulic motor and thereby mixing said load of concrete in said concrete mixer container on said truck, said pump then developing a reaction torque opposite and equal to a reaction torque then developed by said engine, and transmitting said pump and engine reaction torques to said movable frame while said pump and engine are spaced away from sad concrete mixer truck at said second location.

7. Process as in claim 6 wherein said concrete mixer container is connected to said another hydraulic motor and said step of driving said pump by said engine is performed while the said truck is located on a surface at an angle less than an angle to the horizontal at which said concrete mixer and transport truck is unstable and while said pump and engine are located on a surface which extends at an angle to the horizontal greater than said angle to the horizontal.

8. Process as in claim 6 including also:

(a) after said step of developing hydraulic pressure and applying said torque output of said first motor to said concrete mixer container and prior to transporting said load of concrete in said truck, the step of setting indicators on a first gauge responsive to the hydraulic pressure of said pressurized first hydraulic fluid at positions indicative of the slump test characteristics of loads of unset concrete mix in said rotating concrete mixer container at a predetermined range of rates of rotation of said concrete mixer container different from said first speed of rotation of said container and then rotating said container and mixing and transporting said load of concrete in said container on said concrete mixer truck while providing to the driver of said concrete mixer truck substantially continuous indications of the slump test characteristics of said load of concrete while said load of concrete in said concrete mixer container is rotated and mixed and transported in said concrete mixer container on said concrete mixer and transport truck, and (b) after said connecting of said another hydraulic motor to said concrete mixer container and while said another hydraulic motor is mixing said load of concrete in said rotating concrete mixer container, monitoring the pressure of said pressurized second hydraulic fluid passing to said another hydraulic motor with a second gauge having indicators set at positions matching the setting of positions of said indicators on said first gauge.

* * * * *